US006247789B1

(12) United States Patent
Sanada

(10) Patent No.: US 6,247,789 B1
(45) **Date of Patent: *Jun. 19, 2001**

(54) LIQUID EJECTION APPARATUS

(75) Inventor: Kazuo Sanada, Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/122,777

(22) Filed: Jul. 27, 1998

Related U.S. Application Data

(63) Continuation of application No. 08/770,814, filed on Dec. 20, 1996.

(30) Foreign Application Priority Data

Dec. 21, 1995 (JP) ..... 7-333457

(51) Int. Cl.[7] ..... B41J 2/135

(52) U.S. Cl. ..... 347/45; 347/47; 347/68; 347/70

(58) Field of Search ..... 347/47, 42, 92, 347/106, 107, 68, 70, 45; 222/207, 320, 420; 396/604, 605; 239/102.2

(56) References Cited

U.S. PATENT DOCUMENTS

| | | | | |
|---|---|---|---|---|
| 3,941,312 | * | 3/1976 | Ohno et al. | 347/45 |
| 4,605,167 | * | 8/1986 | Maehara | 347/47 |
| 4,771,295 | * | 9/1988 | Baker et al. | 347/87 |
| 5,034,308 | * | 7/1991 | Abe et al. | 430/372 |
| 5,320,250 | * | 6/1994 | La et al. | 222/1 |
| 5,504,516 | | 4/1996 | Bax | 347/238 |
| 5,574,530 | * | 11/1996 | Sanada | 396/604 |
| 5,609,993 | * | 3/1997 | Hase et al. | 347/106 |
| 5,746,373 | * | 5/1998 | Sanada | 239/102.2 |

* cited by examiner

*Primary Examiner*—John Barlow
*Assistant Examiner*—Michael S Brooke
(74) *Attorney, Agent, or Firm*—Sughrue, Mion, Zinn, Macpeak & Seas, PLLC

(57) ABSTRACT

A liquid ejection apparatus includes an ejection tank disposed above a conveying path and storing an image-forming solvent, a nozzle plate provided at the ejection tank as a bottom wall of the ejection tank and having a plurality of nozzle holes for ejecting the image-forming solvent, and at least one actuator for moving the nozzle plate reciprocally toward and away from an image-recording material on the conveying path. As the image-forming solvent is ejected from the nozzle holes, bubbles may enter into the ejection tank by way of the nozzle holes. However, the bubbles rise in the ejection tank without remaining in vicinities of the nozzle holes. As a result, a case in which bubbles close the nozzle holes and prevent the image-forming solvent from being released from the nozzle holes is avoided. Consequently, the image-forming solvent can be uniformly applied onto the image-recording material.

4 Claims, 11 Drawing Sheets

LIQUID EJECTION APPARATUS

This is a continuation of application Ser. No. 08/770,814 filed Dec. 20, 1996, the disclosure of which is incorporated herein by reference.

BACKGROUND OF THE INVENTION

1. Field of the Invention

The present invention relates to a liquid ejection apparatus capable of ejecting an image-forming solvent properly onto an image recording material such as a light-sensitive material or an image-receiving material.

2. Description of the Related Art

Image-forming apparatuses, which record images by using two types of image-recording materials such as a light-sensitive material and an image-receiving material, are known.

An image-forming apparatus of this type comprises an image-forming solvent application section including a tank, for storing an image-forming solvent to be applied to the light-sensitive material. Further, the image-forming apparatus includes a thermal development-transfer section having a heating drum and an endless pressure belt adapted to rotate in pressure-contact with the outer periphery of the heating drum.

The light-sensitive material having an image exposed thereon is, while being held and conveyed in the image-forming apparatus, immersed in the water stored in a tank as an image-forming solvent in the image-forming solvent is applied application section. After water has been applied thereto, the light-sensitive material is sent to the thermal development-transfer section. The image-receiving material is also sent into the thermal development-transfer section in the same way as the light-sensitive material.

In the thermal development-transfer section, the light-sensitive material to which water has been applied is superposed with the image-receiving material, and the superposed light-sensitive material and image-receiving material are wound in close contact on the outer periphery of the heating drum. Further, the two materials are held and conveyed between the heating drum and the endless pressure belt to thermally develop the light-sensitive material. At the same time, the image is transferred to the image-receiving material so as to form (record) a predetermined image on the image-receiving material.

However, in a case in which a light-sensitive material is immersed and coated with water constituting an image-forming solvent in a tank, the water that has contacted the light-sensitive material continues to be held in the tank. As a result, bacteria propagate in the tank by using the organic material, which has slightly eluted from the light-sensitive material, as a source of nutrition. The water thus is liable to be contaminated, which may deteriorate the image-forming apparatus and image quality.

A possible solution to this drawback is to vibrate a nozzle plate in which nozzle holes are formed while keeping the water supplying elements such as the tank out of contact with the light-sensitive material, so that small water drops are ejected toward and applied onto the light-sensitive material. Mere ejection of water drops, however, would cause air bubbles entering into the nozzle holes to remain in vicinities of the nozzle holes, whereby the nozzle holes would be closed by the air bubbles such that water could not be ejected. As a result, water may not adhere to some portions of the light-sensitive material, thereby making it difficult to apply water uniformly onto the light-sensitive material.

An excessively thick nozzle plate, on the other hand, would increase the rigidity of the nozzle plate and reduce the amplitude of the nozzle holes, thereby leading to the disadvantage of unstable atomization. Further, workability would be deteriorated making it difficult to form small nozzle holes of a uniform size.

SUMMARY OF THE INVENTION

In view of the aforementioned, an object of the present invention is to provide a liquid ejection apparatus capable of applying an image-forming solvent uniformly onto an image recording material.

According to one aspect of the present invention, there is provided a liquid ejection apparatus comprising: an ejection tank disposed above a conveying path of an image-recording material so as to oppose the conveying path, and storing an image-forming solvent; a nozzle plate provided at the ejection tank as a bottom wall of the injection tank so as to oppose the conveying path of the image-recording material, and having a plurality of nozzle holes for ejecting the image-forming solvent; and actuator means for moving the nozzle plate reciprocally toward and away from the image-recording material on the conveying path.

This liquid ejection apparatus has the following effects.

The ejection tank for storing the image-forming solvent is disposed above and opposes the conveying path of the image-recording material. The nozzle plate with a plurality of nozzle holes for ejecting the image-forming solvent, is provided at the ejection tank as the bottom wall surface of the ejection tank and opposes the conveying path of the image-recording material. Further, the actuator means causes the nozzle plate to move reciprocally toward and away from the image-recording material on the conveying path.

The operation of the actuator means, therefore, causes the image-forming solvent filled in the ejection tank to be ejected from the plurality of nozzle holes. Since the nozzle holes are formed in the bottom wall of the ejection tank, air bubbles may enter into the ejection tank from the nozzle holes as a result of the ejection of the image-forming solvent. The bubbles, however, do not remain in the vicinities of the nozzle holes but float upward in the ejection tank. As a result, the nozzle holes are not closed by the bubbles, and a case in which the image-forming solvent is not released from the nozzle holes can be avoided. Thus, there are no portions on the image-recording material to which the image-forming solvent is not applied.

Consequently, it is possible to apply the image-forming solvent uniformly onto the image-recording material.

According to another aspect of the present invention, there is provided a liquid ejection apparatus comprising: an ejection tank disposed so as to oppose a conveying path of an image-recording material, and storing an image-forming solvent; a nozzle plate provided at the ejection tank as a portion of a wall surface of the ejection tank so as to oppose the conveying path of the image-recording material, and having a plurality of linearly-aligned nozzle holes for ejecting the image-forming solvent; displacement transmission members coupled to end portions, of the nozzle plate, of a direction perpendicular to a direction in which the plurality of nozzle holes are aligned linearly; support portions extending along the direction in which the plurality of nozzle holes are aligned linearly, and swingably supporting the displacement transmission members; and actuator means disposed so as to contact positions of the displacement transmission members which positions are at the opposite sides of the support portions with respect to the plurality of nozzle holes, the actuator means ejecting the image-forming solvent from the plurality of nozzle holes by swinging the displacement transmission members around the support portions.

The liquid ejection apparatus of this aspect of the present invention achieves the following effects.

The ejection tank for storing the image-forming solvent is disposed so as to oppose the conveying path of the image-recording material. The nozzle plate having the plurality of linearly-aligned nozzle holes for ejecting the image-forming solvent is provided at the ejection tank as a portion of the wall of the ejection tank and opposes the conveying path of the image-recording material.

Further, the displacement transmission members, which are coupled to the end portions of the nozzle plate in a direction perpendicular to the direction in which the nozzle holes are aligned linearly, are swingably supported by the support portions extending along the direction of linear alignment of the nozzle holes. Further, the actuator means causes the displacement transmission members to swing around the support portions so that the nozzle plate coupled to the displacement transmission members applies pressure to the image-forming solvent stored in the ejection tank.

Upon activation of the actuator means, the displacement transmission members swing around the support portions extending along the direction in which the nozzle holes are aligned linearly. The portions of the nozzle plate corresponding to the nozzle holes, therefore, are displaced uniformly so as to cause the image-forming solvent filled in the ejection tank to be uniformly ejected from the nozzle holes.

As a result, the image-forming solvent is applied onto the entire image-recording material without fail thereby making it possible to apply the image-forming solvent uniformly to the image-recording material.

According to still another aspect of the present invention, there is provided a liquid ejection apparatus comprising: an ejection tank disposed so as to oppose a conveying path of an image-recording material, and storing an image-forming solvent; a thin nozzle plate provided at the ejection tank as a portion of a wall surface of the ejection tank so as to oppose the conveying path of the image-recording material, and having a plurality of linearly-aligned nozzle holes for ejecting the image-forming solvent, and a curved groove portion extending along a direction in which the plurality of nozzle holes are aligned linearly being formed in the nozzle plate; and actuator means for moving the nozzle plate reciprocally toward and away from the image-recording material on the conveying path.

The liquid ejection apparatus of this aspect of the invention has the following effects.

The ejection tank for storing the image-forming solvent is disposed so as to oppose the conveying path of the image-recording material. The nozzle holes for ejecting the image-forming solvent are aligned linearly, and the thin nozzle plate formed with a curved groove extending along the direction in which the nozzle holes are aligned linearly is provided at the ejection tank. Further, the actuator means causes the nozzle plate to move reciprocally toward and away from the image-recording material on the conveying path.

Since the nozzle plate is formed by a thin plate material having a groove, the rigidity of the nozzle plate in the direction along which the nozzle holes are aligned linearly is maintained while the rigidity of the nozzle plate in the direction perpendicular to the direction in which the nozzle holes are aligned linearly is reduced. As a result, the amplitude required of a nozzle hole is ensured, the atomization operation of the liquid ejection apparatus is stabilized, and the image-forming solvent filled in the ejection tank is reliably ejected from the nozzle holes.

Furthermore, since the nozzle plate is formed by a thin plate material, small nozzle holes of a uniform size can be easily formed in the nozzle plate at the time of manufacturing the liquid ejection apparatus.

DETAILED DESCRIPTION OF THE PREFERRED EMBODIMENTS

Figure 1:
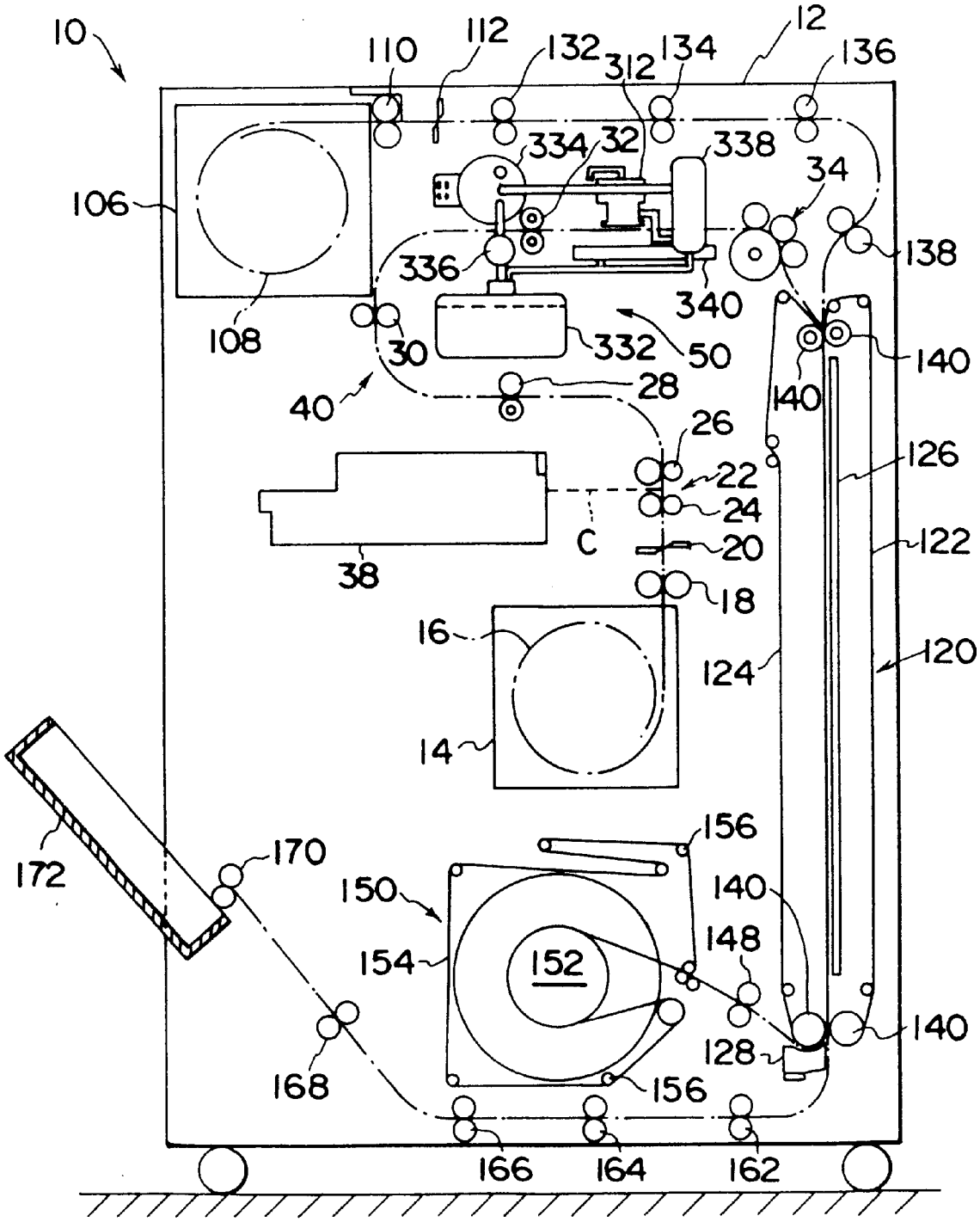
FIG. 1 is a schematic structural view of an image-recording apparatus according to a first embodiment of the invention.

FIG. 1 is a schematic view of the overall structure of an image-recording apparatus 10 which is an image-forming apparatus according to a first embodiment of the present invention.

A light-sensitive material magazine 14 for accommodating a light-sensitive material 16 is disposed in a housing 12 of the image-recording apparatus 10 shown in FIG. 1. The light-sensitive material 16 is taken up in a roll form in the light-sensitive material magazine 14 such that the light-sensitive (exposure) surface of the light-sensitive material 16 is directed to the left when the light-sensitive material 16 is withdrawn from the light-sensitive material magazine 14.

A nip roller 18 and a cutter 20 are disposed in the vicinity of the light-sensitive material withdrawal opening of the light-sensitive material magazine 14. The light-sensitive material 16 that has been withdrawn from the light-sensitive material magazine 14 by a predetermined length can be cut off by this cutter 20. The cutter 20 is a rotary type cutter including a fixed blade and a movable blade, for example, and can cut the light-sensitive material 16 with the movable blade moved vertically by a rotating cam or the like to mesh with the fixed blade.

A plurality of conveying rollers 24, 26, 28, 30, 32, 34 are arranged in that order downstream of the cutter 20 in the direction in which the light-sensitive material 16 is conveyed. A guide plate (not shown) is interposed between each pair of the conveying rollers. The light-sensitive material 16 cut to a predetermined length is conveyed first to an exposure section 22 disposed between the conveying rollers 24, 26.

An exposure unit 38 is disposed at the left of the exposure section 22. The exposure unit 38 includes three types of LDs (laser diodes), a lens unit, a polygonal mirror and a mirror unit (none of which are shown). A light beam C is emitted from the exposure unit 38 to the exposure section 22 to expose the light-sensitive material 16.

Further, a U-turn section 40 for conveying the light-sensitive material 16 along a U-shaped curved path and a water application section 50 for applying an image-forming solvent are disposed above the exposure section 22. In the present embodiment, water is used as the image-forming solvent.

The light-sensitive material 16 that has been conveyed upward from the light-sensitive material magazine 14 and exposed in the exposure section 22 is conveyed while being held between the conveying rollers 28, 30, and thus is sent into the water application section 50 along the upper portion of the U-turn section 40 of the conveying path.

Figure 2:
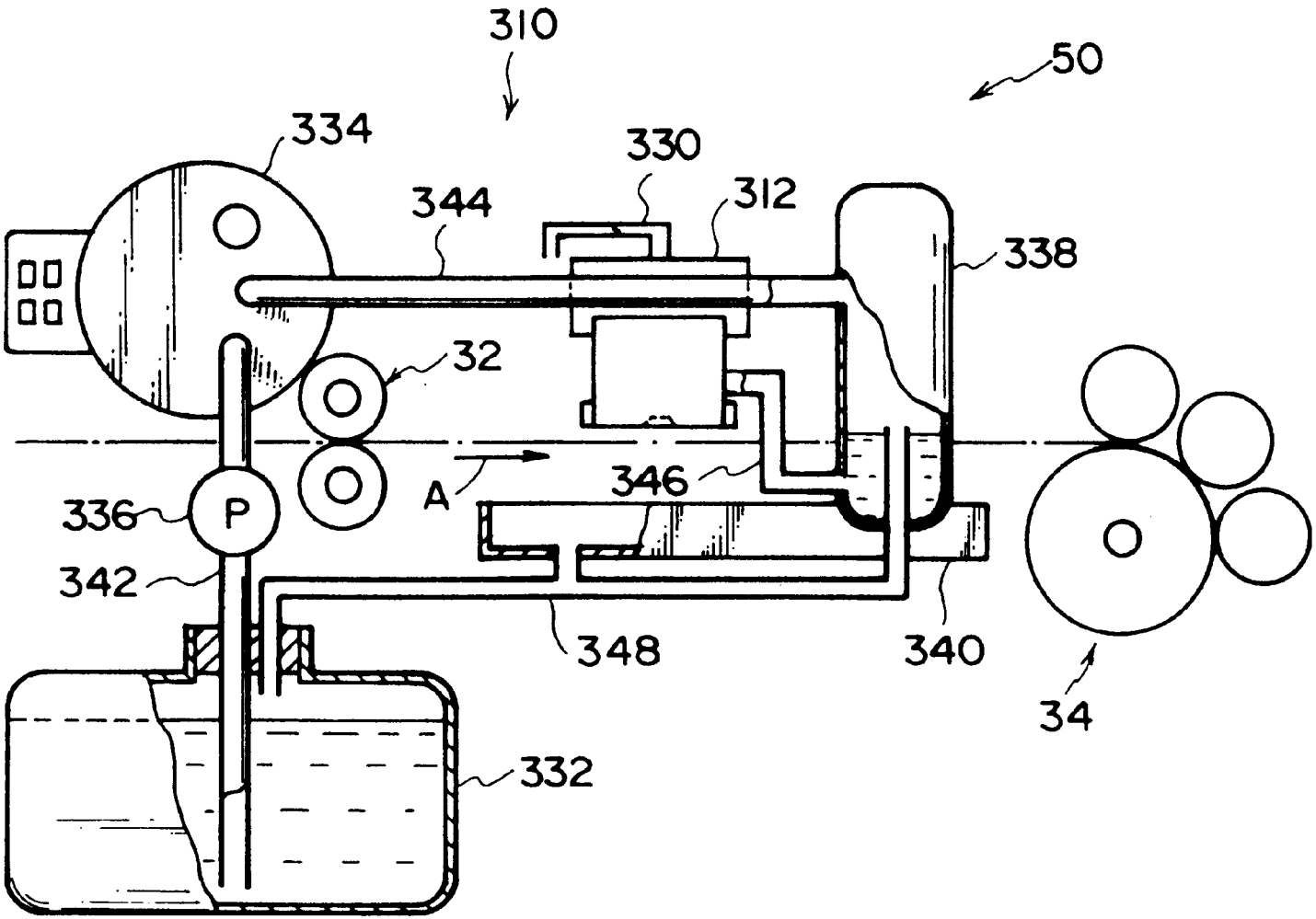
FIG. 2 is a schematic structural view of a solvent application device according to the first embodiment of the invention.

As shown in FIG. 2, an ejection tank 312, which constitutes a portion of a solvent application device 310 which is a liquid ejection device, is disposed at a portion of the water application section 50 which opposes the conveying path A of the light-sensitive material 16.

As shown in FIG. 2, a water bottle 332 for storing water to be supplied to the ejection tank 312 is disposed at the lower left of the ejection tank 312. A water filter 334 is disposed above the water bottle 332. The water bottle 332 and the filter 334 are connected by a water pipe 342 along which a pump 336 is disposed.

Further, a subtank 338 for storing water supplied from the water bottle 332 is disposed at the right of the ejection tank 312. A water pipe 344 extends from the filter 334 to the subtank 338.

When the pump 336 is activated, water is sent from the water bottle 332 to the filter 334, and the water filtered through the filter 334 is supplied to the subtank 338 where it is stored temporarily.

A water pipe 346 for connecting the subtank 338 and the side portion of one end side of the ejection tank 312 is arranged between the ejection tank 312 and the subtank 338. The water sent by the pump 336 from the water bottle 332 through the filter 334, the subtank 338, and the water pipe 346 is filled into the ejection tank 312.

A tray 340 connected to the water bottle 332 by a circulation pipe 348 is disposed under the ejection tank 312. The water which overflows from the ejection tank 312 is collected in the tray 340 and returned through the circulation pipe 348 to the water bottle 332. Further, the circulation pipe 348 extends so as to project into the subtank 338, and is connected to the subtank 338. The excess water stored in the subtank 338 is returned to the water bottle 332 through the circulation pipe 348.

Figure 4:
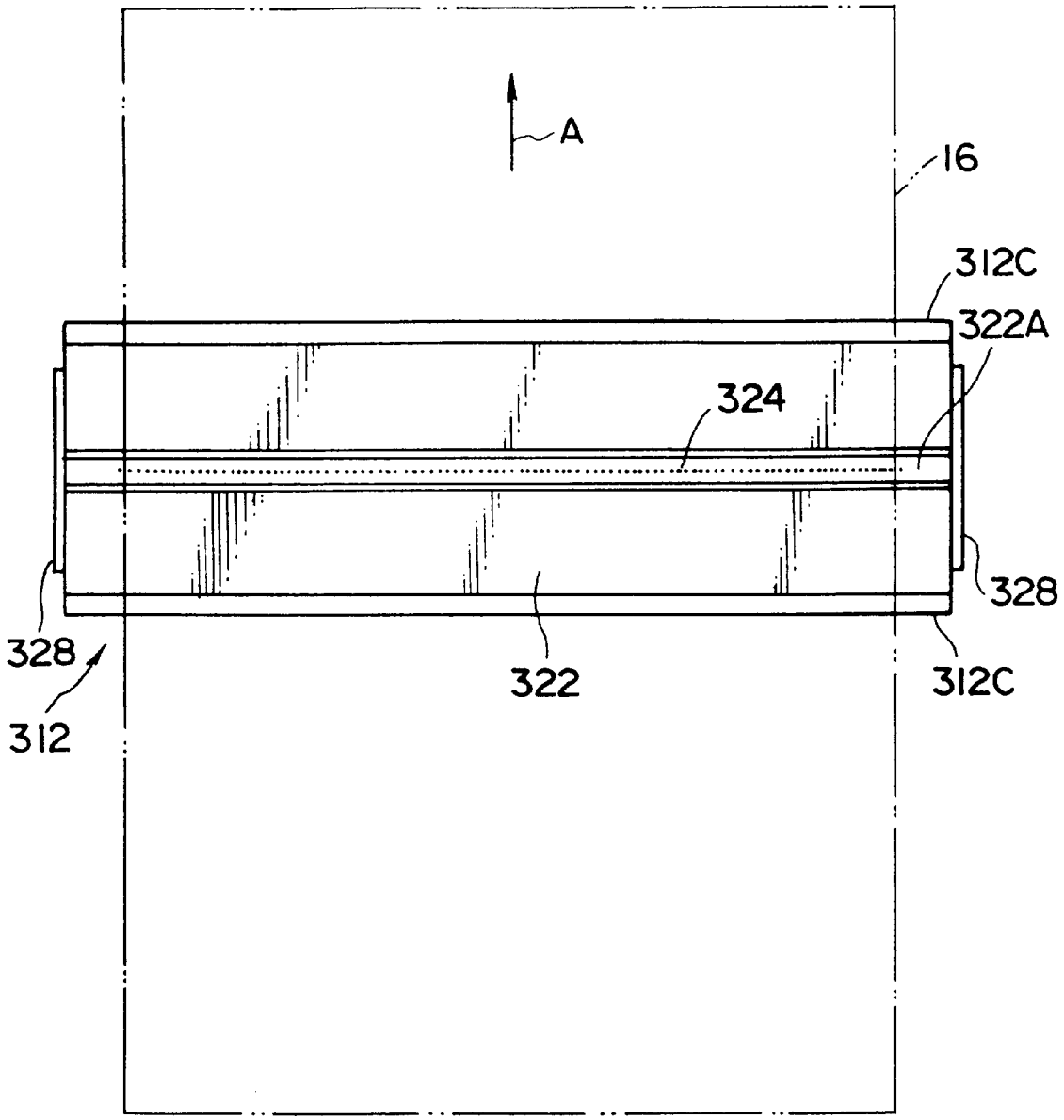
FIG. 4 is a bottom view showing the manner in which a light-sensitive material is conveyed under the ejection tank according to the first embodiment of the invention.
Figure 6:
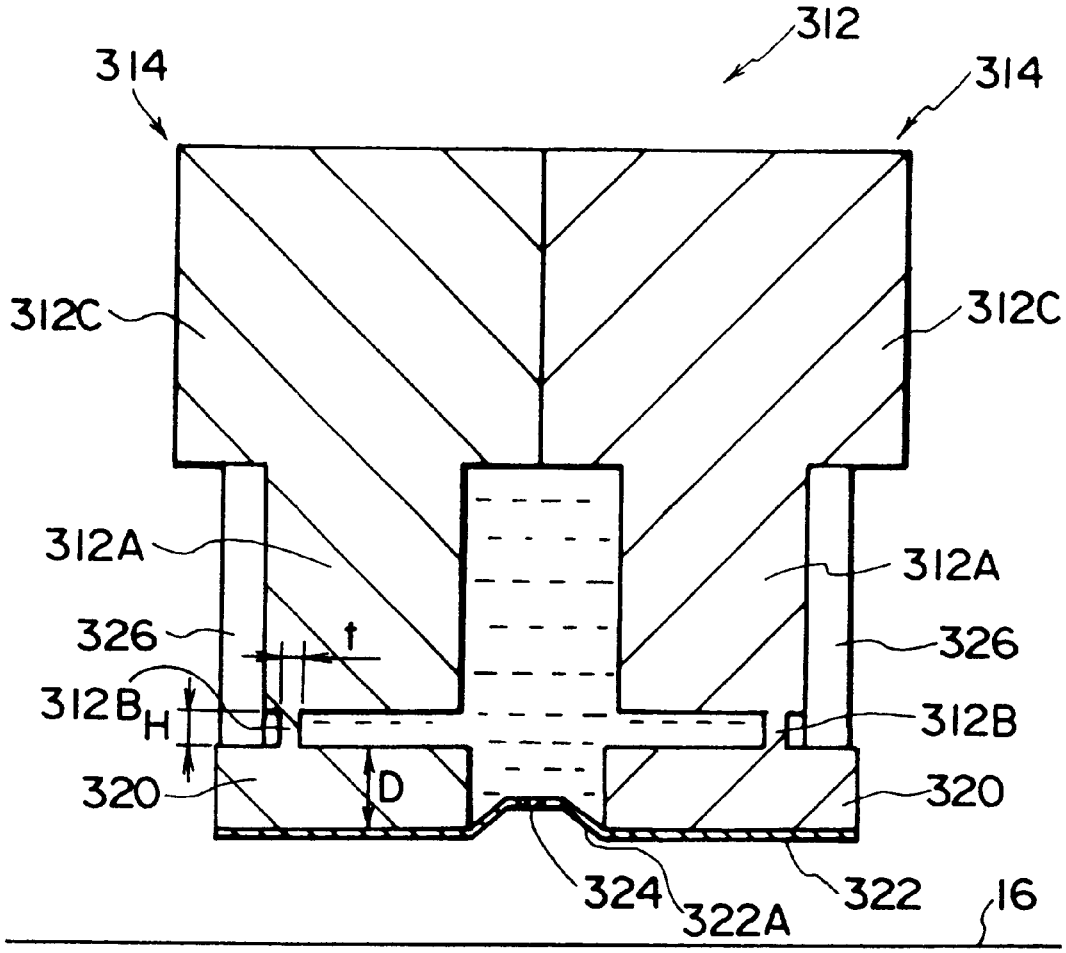
FIG. 6 is a sectional view of the ejection tank according to the first embodiment of the invention.

Further, as shown in FIGS. 4 and 6, a nozzle plate 322 formed by an elastically deformable, rectangular, thin-plate-shaped material (not more than 60 $\mu$m thick, for example) is provided as the bottom wall surface of the ejection tank 312, i.e., a part of the walls of the ejection tank 312, so as to oppose the conveying path A of the light-sensitive material 16.

Figure 3:
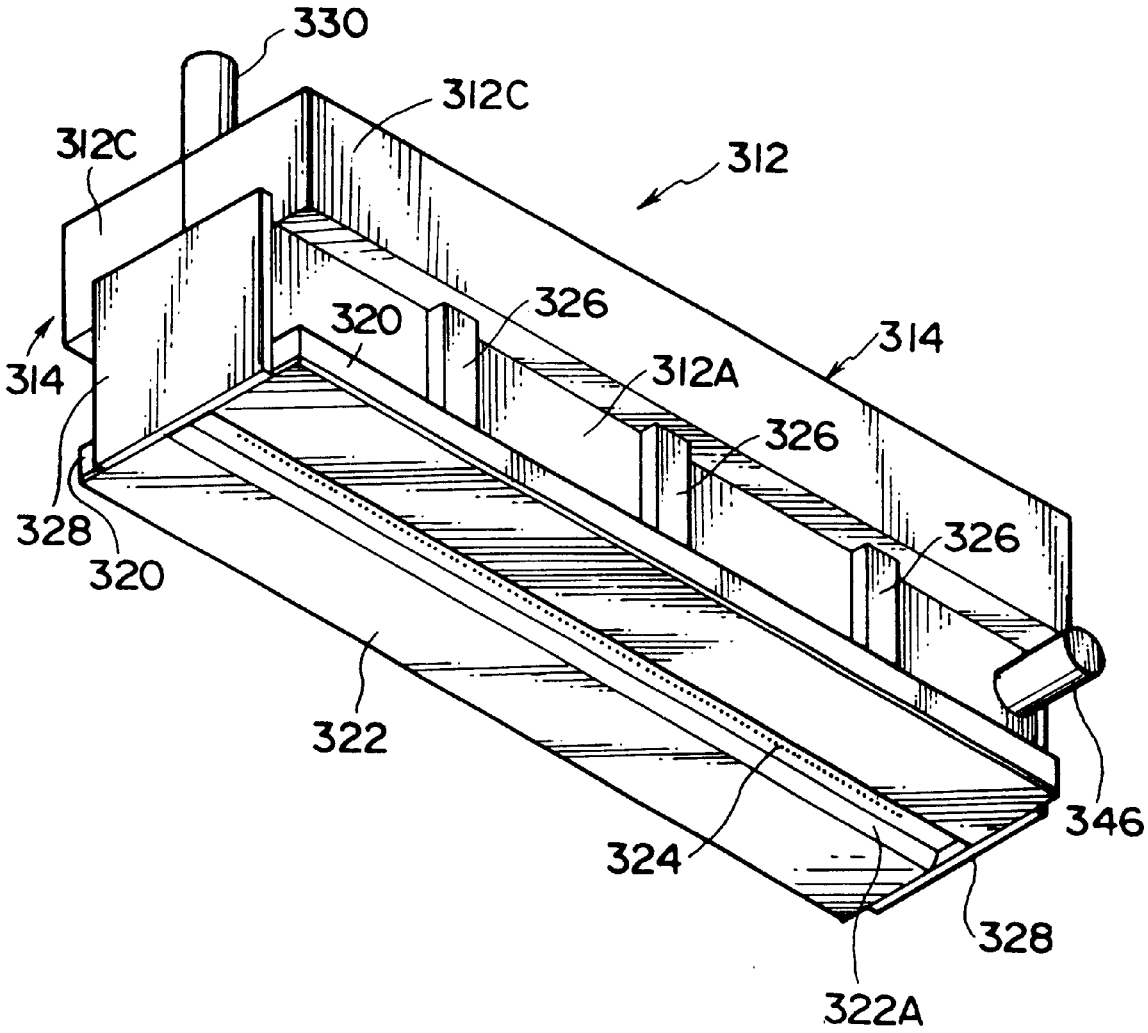
FIG. 3 is an enlarged perspective view of an ejection tank according to the first embodiment of the invention.
Figure 5:
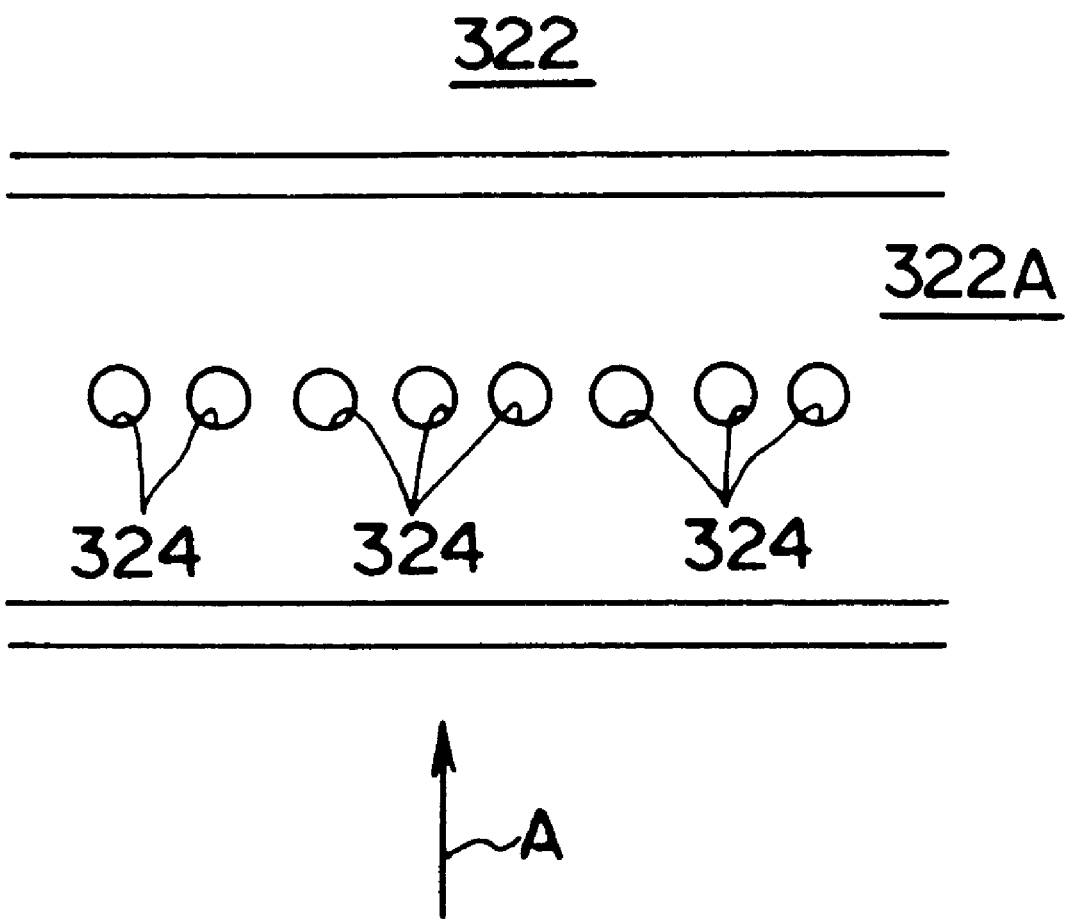
FIG. 5 is an enlarged view of main portions of FIG. 4.

As shown in FIGS. 3 to 5, the nozzle plate 322 has a plurality of nozzle holes 324 (10 $\mu$m to 200 $\mu$m in diameter, for example) arranged at regular spatial intervals over the entire width of the light-sensitive material 16 linearly at an angle to the direction A in which the light-sensitive material 16 is conveyed. The water filled in the ejection tank 312 is released from and ejected toward the light-sensitive material 16 by way of the nozzle holes 324.

A curved groove 322A is formed in the nozzle plate 322. The groove 322A extends along the direction along which the nozzle holes 324 are aligned in order to improve the rigidity of the nozzle plate 322 in the longitudinal direction thereof, which is the direction along which the nozzle holes 324 are aligned.

The water that has come out of the nozzle holes 324 due to water pressure when water is stored in the ejection tank 312 may connect between adjacent nozzle holes 324 and may cause water leakage from a nozzle hole which is now apparently larger. In order to prevent such water leakage, a water repellent processing such as NiP plating is effected on the lower surface of the nozzle plate 322 which is the outer side surface of the ejection tank 312.

Figure 8:
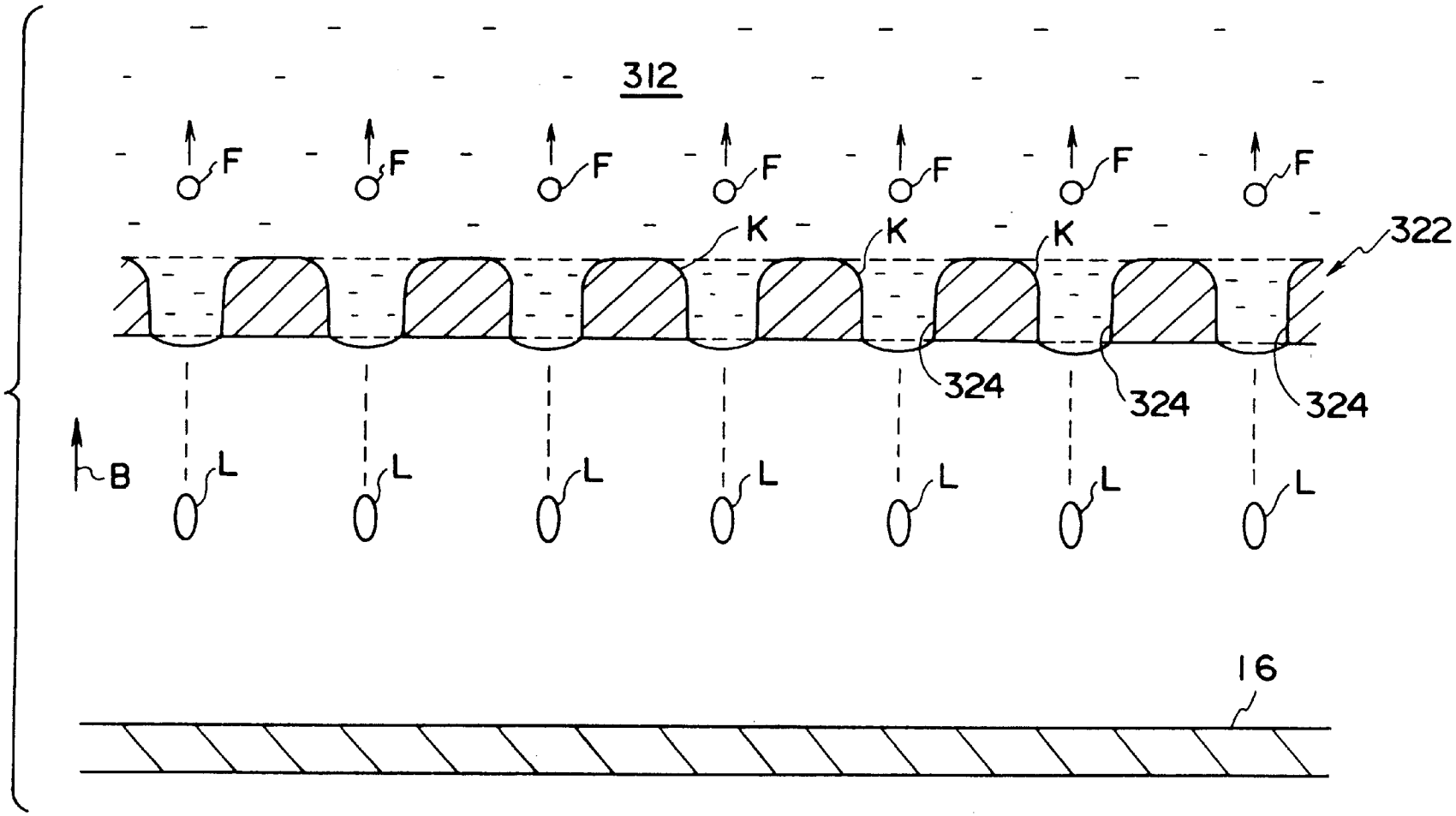
FIG. 8 is a sectional view of the ejection tank for explaining the behavior of bubbles in the ejection tank according to the first embodiment of the invention.
Figure 11:
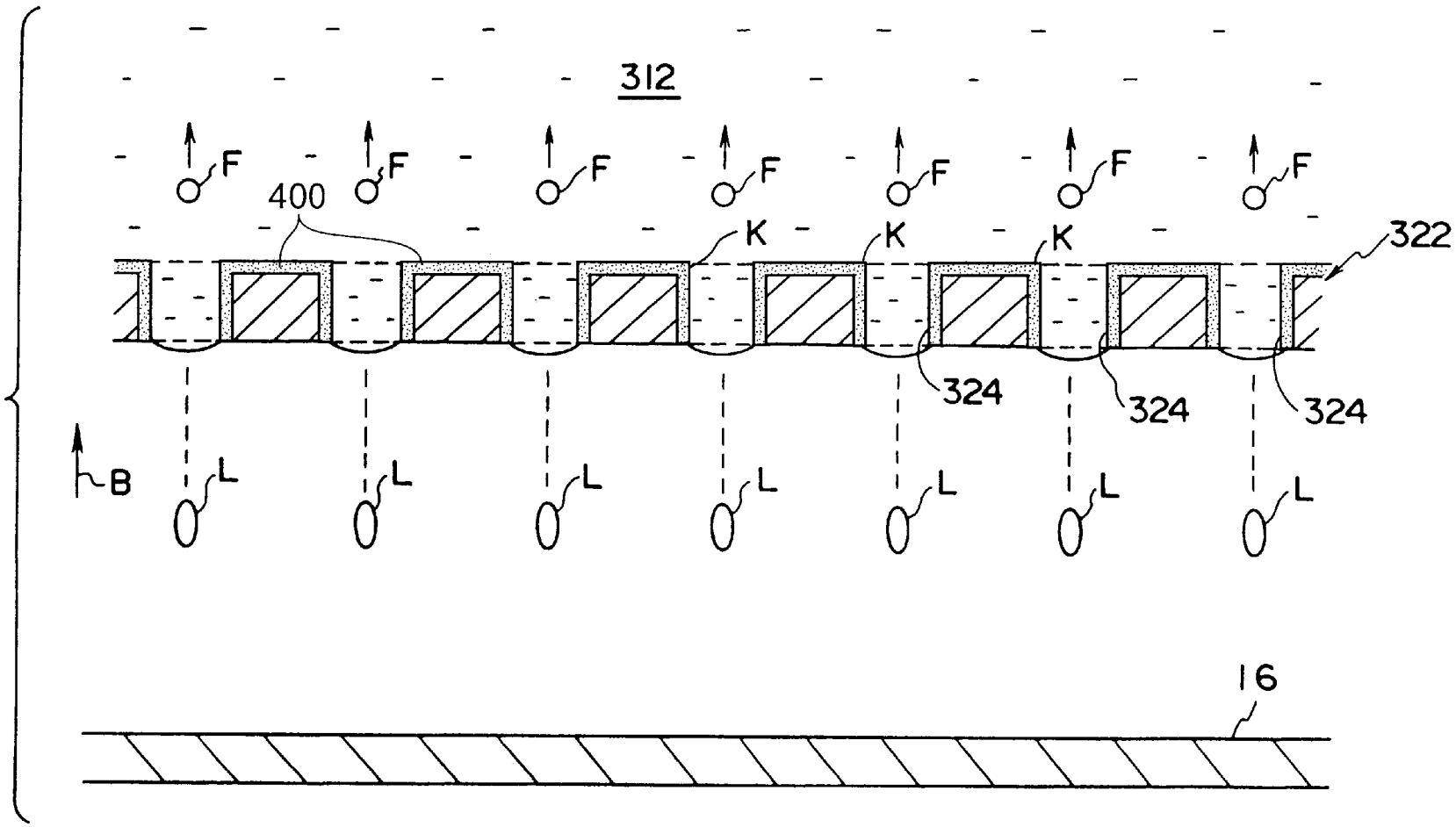
FIG. 11 is a sectional view of the injection tank for explaining the behavior of bubbles in the injection tank according to the first embodiment of the invention.

Further, in order to prevent bubbles F from adhering to the peripheral parts of the nozzle holes 324, as shown in FIG. 8, corners K of the nozzle plate 322 around the nozzle holes 324 inside the ejection tank 312 are formed to have curved cross-sections or are subjected to hydrophilic processing (see FIG. 11, with a hydrophilic coating shown by 400).

As shown in FIGS. 2 and 3, an exhaust pipe 330 extends from the upper portion of the ejection tank 312, i.e., at the side of the ejection tank 312 opposite the side connected to the water pipe 346, so as to provide communication between the outside and inside of the ejection tank 312. A valve (not shown) for opening and closing the exhaust pipe 330 is installed along the route of the exhaust pipe 330. The opening/closing operation of this valve permits the interior of the ejection tank 312 to communicate with or be shut off from the exterior environment.

The end portions of the nozzle plate 322 in the direction orthogonal to the longitudinal direction of the nozzle hole row formed by the plurality of nozzle holes 324 arranged linearly are, as shown in FIG. 6, bonded by an adhesive or the like to a pair of lever plates 320, respectively, which are a displacement transmission member. The nozzle plate 322 is thus adhesively coupled with the pair of lever plates 320. The lever plates 320 are fixed to a pair of side walls 312A of the ejection tank 312, respectively, via support portions 312B formed under the side walls 312A. These support portions 313B have narrow widths and extend along the direction in which the nozzle holes 324 are aligned linearly.

A pair of top walls 312C contact each other and form the top side of the ejection tank 312. Portions of these top walls 312C protrude to the outer sides of the ejection tank 312, and a plurality of piezoelectric elements 326 (three on each side in accordance with the present embodiment) serving as actuator means are adhered to the lower side of the protruding portion of each of the top walls 312C. The lower surfaces of the piezoelectric elements 326 are bonded to the outer ends of the lever plates 320 which are at the opposite sides of the support portions 312B with respect to the nozzle holes 324. The piezoelectric elements 326 and the lever plates 320 are thus coupled to each other.

The piezoelectric elements 326, the lever plates 320 and the support portions 312B form a lever mechanism. When the outer side ends of the lever plates 320 are moved by the piezoelectric elements 326, the lever plates 320 are swung around the support portions 312B, while the inner side ends of the lever plates 320 move in the opposite direction. The piezoelectric elements 326 are formed of laminated piezoelectric ceramics, for example, to ensure a greater axial displacement of the piezoelectric elements 326. The piezoelectric elements 326 are connected to a power supply (not shown) to which a voltage is applied at a timing controlled by a controller (not shown). The above-described valve for opening and closing the exhaust pipe 330 is also connected to the controller, and the opening and closing operation of the valve is controlled by the controller.

The lever plate 320, the side wall 312A, the support portion 312B and the top wall 312C each form a portion of an integrated frame 314. As shown in FIG. 6, a pair of the frames 314 are overlaid and screwed to each other by bolts (not shown). In this way, the outer frame of the ejection tank 312 is made up of a pair of the lever plates 320, a pair of the side walls 312A, a pair of the top walls 312C and a pair of the support portions 312B respectively arranged in opposed relations to each other.

The frame 314 is formed of a metal material such as aluminum, brass or magnesium. The component parts of the frame 314 have such specific sizes that, as shown in FIG. 6, the thickness D of the lever plate 320 is 2 to 8 mm, the hinge thickness t which is the width of the support portion 312B is 0.2 to 1 mm, and the hinge height H which is the height of the support portion 312B is 0.6 to 3 mm.

Specifically, the lever plates 320 must have a sufficient rigidity to swing integrally as a rigid member, and the thickness D thereof is 2 to 8 mm. An extremely small value of the hinge thickness t of the support portions 312B would make processing difficult and would result in the support portions 312B breaking easily. In contrast, if the hinge thickness t is larger than necessary, movement of the lever plates 320 would be limited. Further, an excessively large hinge height H causes the support portions 312B to bend easily. These drawbacks do not arise if the dimensional ranges defined above are employed.

Further, the magnification rate of the lever mechanism, which is the displacement amount of the nozzle plate 322 at the peripheries of the nozzle holes 324 with respect to the displacement amount of the piezoelectric elements 326, can be set in the range of one to 20 times by the lever plates 320 and the support portions 312B of the sizes defined above.

As described above, a small number of piezoelectric elements 326 can produce a large, uniform amplitude of the nozzle plate 322 along the direction in which the plurality of nozzle holes 324 are aligned. As a result, the nozzle plate 322 can have such an amplitude that the amplitude distribution along the width of the light-sensitive material 16 is uniform and the water pressure at the periphery of each nozzle hole 324 reaches a level sufficient for atomization. Consequently, water can be ejected and atomized from the nozzle holes 324 substantially uniformly along the entire width of the light-sensitive material 16.

As shown in FIGS. 3 and 4, a thin sealing plate 328 is bonded to the pair of the frames 314 at a position defined by each end pair of the frames 314 and each longitudinal end of the nozzle plate 322 positioned in the longitudinal direction of the nozzle hole row formed by the nozzle holes 324.

Further, an elastic adhesive such as silicon rubber for example is filled, at the inner sides of the sealing plates 328, to prevent water leakage from the gap defined between the sealing plates 328, the longitudinal ends of the nozzle plate 322, and the longitudinal ends of the frame pair 314. The space in the ejection tank 312 thus is sealed by the elastic adhesive without adversely affecting the movement of the longitudinal ends of the nozzle plate 322.

Alternatively, the longitudinal ends of the ejection tank 312 may be sealed only by the elastic adhesive without using the thin sealing plates 328.

Figure 7:
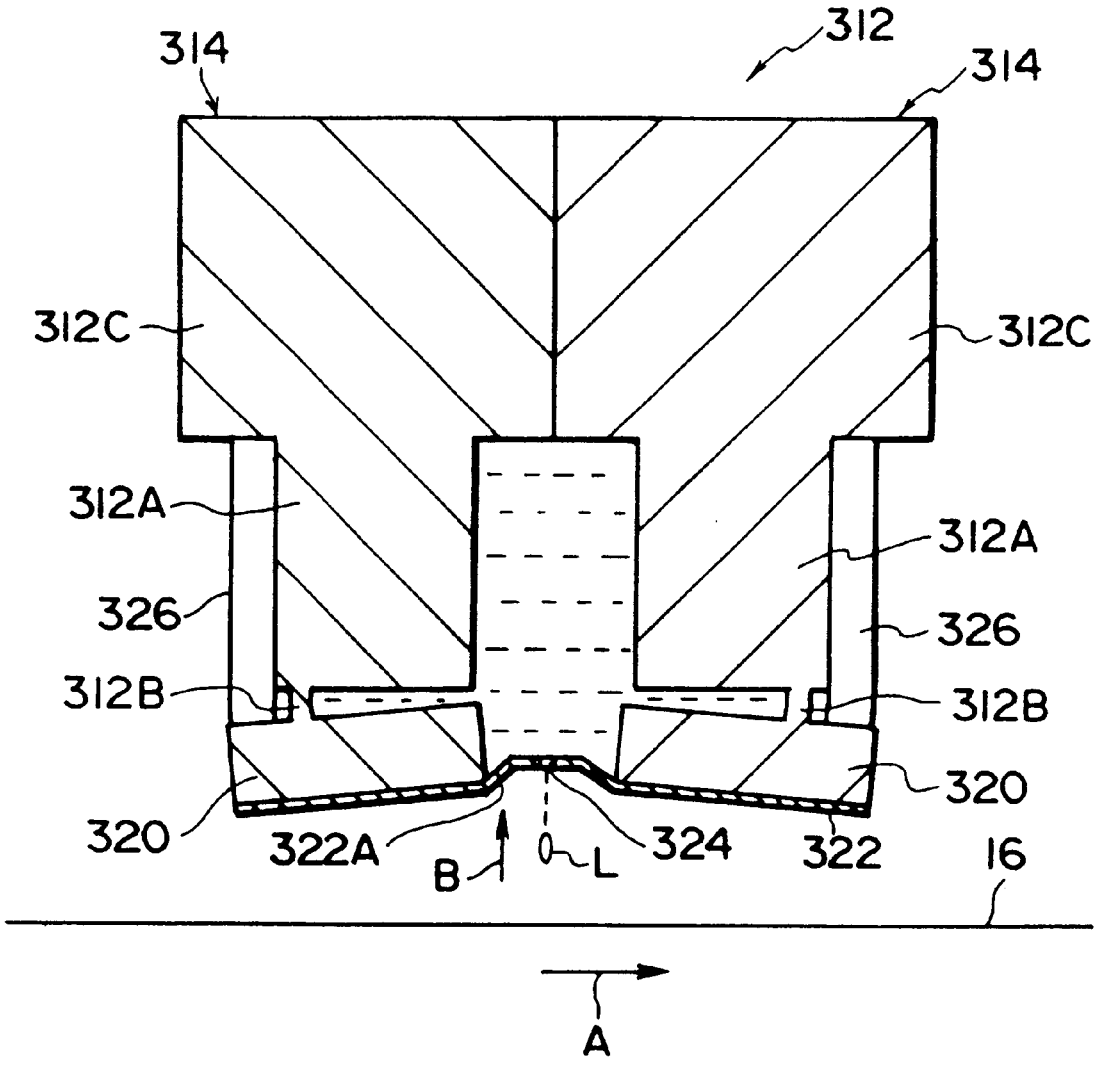
FIG. 7 is a sectional view showing the manner in which water is ejected from the ejection tank according to the first embodiment of the invention.

When power is supplied to the piezoelectric elements 326 from a power supply, as shown in FIG. 7, the piezoelectric elements 326 extend so as to rotate the lever plates 320 around the support portions 312B. Accordingly, the nozzle plate 322 is displaced while being deformed by the piezoelectric elements 326 via the lever plates 320 such that the central portion of the nozzle plate 322 is raised in the direction of arrow B. The deformation of the nozzle plate 322 increases the internal pressure of the ejection tank 312, with the result that water drops L which are a small amount of water are collectively ejected along a line from the nozzle holes 324.

The water drops L can be continuously ejected from the nozzle holes 324 by supplying power to and extending the piezoelectric elements 326 repeatedly.

As shown in FIG. 1, an image-receiving material magazine 106 for accommodating the image-receiving material 108 is disposed at the upper left corner of the housing 12 in FIG. 1. The image-forming surface of the image-receiving material 108 is coated with a dye-fixing material having a mordant. The image-receiving material 108 is taken up in roll form in the image-receiving material magazine 106 in such a manner that the light-receiving material 108 is withdrawn from the image-receiving material magazine 106 with the image-forming surface thereof facing down.

A pair of nip rollers 110 are disposed in the vicinity of the image-receiving material withdrawal opening of the image-receiving material magazine 106. The nip rollers 110 nip the image-receiving material 108 out of the image-receiving material magazine 106. The nipping of the image-receiving material 108 by the nip rollers 110 can also be canceled.

A cutter 112 is disposed next to the nip rollers 110. Similarly to the cutter 20 for the light-sensitive material described above, the cutter 112 is a rotary type cutter including a fixed blade and a movable blade, for example. The movable blade of the cutter 112 is moved vertically by a rotary cam or the like into engagement with the fixed blade to thereby cut the image-receiving material 108 withdrawn from the image-receiving material magazine 106 to a length shorter than the light-sensitive material 16.

Conveying rollers 132, 134, 136, 138 and a guide plate (not shown) are disposed next to the cutter 112 so as to convey the image-receiving material 108 which has been cut to a predetermined length toward the thermal development-transfer section 120.

Figure 9:
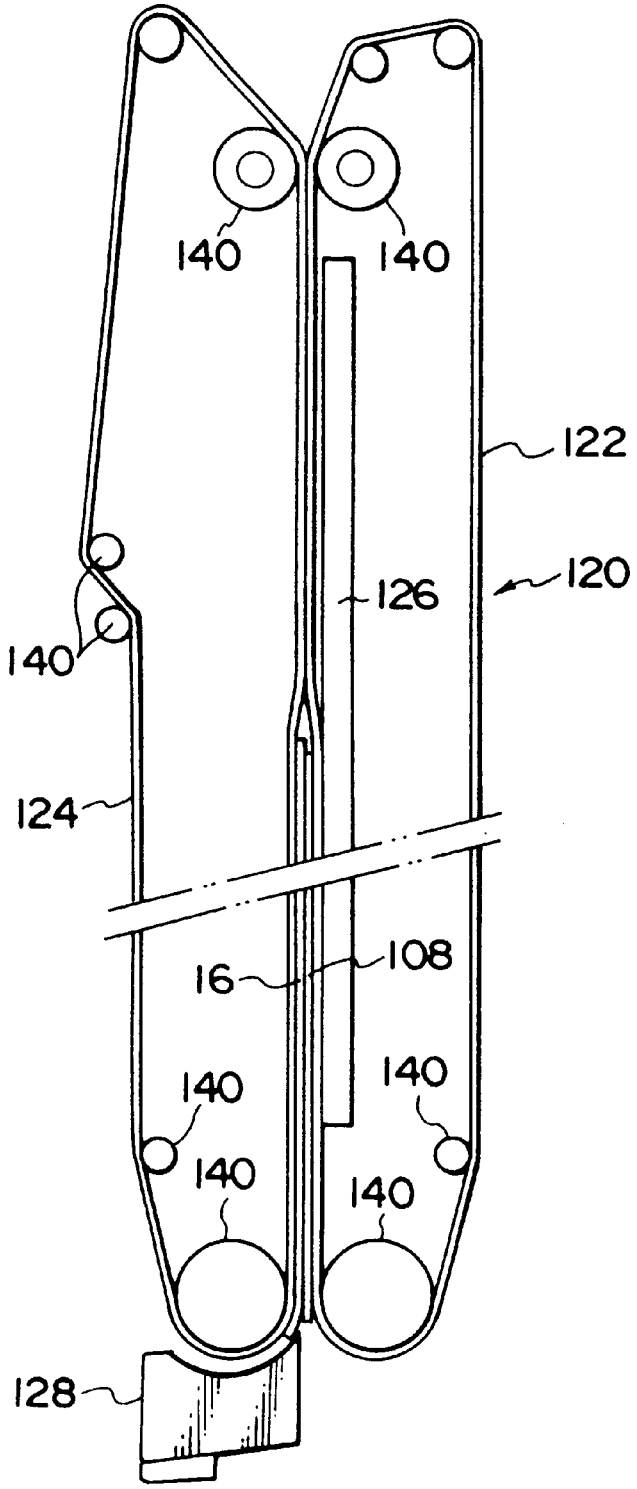
FIG. 9 is an enlarged view of a thermal development-transfer means according to the first embodiment of the invention.

As shown in FIGS. 1 and 9, the thermal development-transfer section 120 includes a pair of endless belts 122, 124 vertically entrained in loops about a plurality of suspension rollers 140. When any one of the suspension rollers 140 is driven to rotate, the endless belts 122, 124 entrained about on the suspension rollers 140 begin to rotate.

A flat heating plate 126 is vertically disposed in the loop of the endless belt 122 so as to oppose the inner peripheral surface of the endless belt 122. The heating plate 126 has disposed therein a linear heater (not shown) to heat the surface of the heating plate 126 to a predetermined temperature.

The light-sensitive material 16 is fed between the endless belts 122, 124 of the thermal development-transfer section 120 by the last conveying rollers 34 on the conveying path of the light-sensitive material 16. The image-receiving material 108 is fed synchronously with the light-sensitive material 16. The image-receiving material 108 is, by the last conveying rollers 138 on the conveying path of the image-receiving material 108, fed in between the pair of endless belts 122, 124 and superposed with the light-sensitive material 16, with the light-sensitive material 16 being conveyed a predetermined length ahead of the image-receiving material 108.

The image-receiving material 108 is smaller in both width and length than the light-sensitive material 16. The image-receiving material 108 and the light-sensitive material 16, therefore, are overlaid on each other with the four peripheral sides of the light-sensitive material 16 extending beyond the periphery of the image-receiving material 108.

The light-sensitive material 16 and the image-receiving material 108 overlaid by the endless belts 122, 124 in the manner described above are held and conveyed by the endless belts 122, 124 in this overlaid state. Once the overlaid light-sensitive material 16 and the image-receiving material 108 are completely accommodated between the endless belts 122, 124, the endless belts 122, 124 stop rotating, so that the light-sensitive material 16 and the image-receiving material 108 are heated by the heating plate 126. The light-sensitive material 16 is thus heated through the endless belt 122 and the heating plate 126 both while being conveyed and while in a stationary state. As the heating progresses, the movable dye is released and transferred from the light-sensitive material 16 to the dye fixing layer of the image-receiving material 108 to thereby form an image on the image-receiving material 108.

A separation pawl 128 is disposed downstream of the endless belts 122, 124 in the direction in which the materials are supplied. The separation pawl 128 is adapted to engage with only the leading end portion of the light-sensitive material 16 held and conveyed between the endless belts 122, 124. The leading end portion of the light-sensitive material 16 projecting from between the endless belts 122, 124 can thus be separated from the image-receiving material 108.

Light-sensitive material delivery rollers 148 are disposed to the left (in FIG. 1) of the separation pawl 128. The light-sensitive material 16 guided leftward by the separation pawl 128 can thus be fed further toward a waste light-sensitive material accommodation section 150.

The waste light-sensitive material accommodation section 150 includes a drum 152, on which the light-sensitive material 16 is wound, and a belt 154, a portion of which is entrained around the drum 152. The belt 154 is also entrained about a plurality of rollers 156. Due to the rotation of the rollers 156, the belt 154 is turned thereby to rotate the drum 152.

When the light-sensitive material 16 is fed in while the belt 154 is driven by the rotation of the rollers 156, the light-sensitive material 16 can be accumulated around the drum 152.

Image-receiving material delivery rollers 162, 164, 166, 168, 170 are arranged in that order to convey the image-receiving material 103 leftward in FIG. 1 from under the endless belts 122, 124. As a result, the image-receiving material 108 that has been delivered from the endless belts 122, 124 is conveyed by the material delivery rollers 162, 164, 166, 168, 170 into a tray 172.

Operation of the present embodiment will be explained below.

In the image-recording apparatus 10 having the above-described structure, after the light-sensitive material magazine 14 is set in position, the nip rollers 18 are activated so as to withdraw the light-sensitive material 16. As soon as the light-sensitive material 16 is withdrawn by a predetermined length, the cutter 20 is activated to cut the light-sensitive material 16 to a predetermined length, and the cut light-sensitive material 16 is conveyed to the exposure section 22 with the light-sensitive (exposure) surface thereof directed to the left in FIG. 1. While the light-sensitive material 16 is passing through the exposure section 22, the exposure unit 38 is activated so as to scan-expose an image on the light-sensitive material 16 located in the exposure section 22.

When exposure has been completed, the light-sensitive material 16 thus exposed is conveyed to the water application section 50. The water application section 50 delivers the light-sensitive material 16 toward the ejection tank 312 by driving the conveying rollers 32, as shown in FIG. 4.

The ejection tank 312 ejects water and applies the water to the light-sensitive material 16 fed along the conveying path A. The operation and effects at this time will now be explained.

The ejection tank 312 storing water therein is disposed above the conveying path A of the light-sensitive material 16 so as to oppose the conveying path A. The nozzle plate 322 having a plurality of linearly-arranged nozzle holes 324 for ejecting water is provided at the ejection tank 312 as the bottom wall of the ejection tank 312 so as to oppose the conveying path A of the light-sensitive material 16.

Further, the end portions of the nozzle plate 322 in the direction orthogonal to the direction in which the plurality of nozzle holes 324 are aligned linearly, are each coupled to an elongate lever plate 320. These lever plates 320 are swingably supported by the pair of support portions 312B extending along the direction in which the nozzle holes 324 are aligned linearly.

Before water is ejected from the ejection tank 312, the valve of the exhaust pipe 330 is closed by the controller. When water is to be atomized and ejected in this state, voltage is applied to the piezoelectric elements 326 from a power supply controlled by the controller, so that all of the piezoelectric elements 326 are deformed and extended at the same time.

When the plurality of the piezoelectric elements 326 are extended or contracted simultaneously, the pair of the lever plates 320 swing around the support portions 312B, respectively. The portion of the nozzle plate 322 at the periphery of the nozzle holes 324 located between the lever plates 320 is moved reciprocally toward or away from the light-sensitive material 16 on the conveying path A. When the piezoelectric elements 326 are extended so that the portion of the nozzle plate 322 at the periphery of the nozzle holes 324 is moved away from the light-sensitive material 16 (i.e., in the direction of arrow B in FIG. 7), the water in the ejection tank 312 is pressured by the nozzle plate 322.

As a result of the above-mentioned operation of the piezoelectric elements 326, the water filled in the ejection tank 312 is ejected from the nozzle holes 324. The water filled in the ejection tank 312 can thus be atomized while being ejected from the nozzle holes 324 and made to adhere to the light-sensitive material 16 which is being conveyed, as shown in FIG. 7.

The ejection of the water may cause bubbles F to enter into the ejection tank 312 from the nozzle holes 324. However, since the nozzle holes 324 are formed in the bottom wall surface of the ejection tank 312, the bubbles F rise upward in the ejection tank 312 without remaining in the vicinity of the nozzle holes 324. Consequently, a case in which the nozzle holes 324 are clogged by the bubbles F and the water is prevented from being ejected from the nozzle holes 324 is avoided, thereby ensuring that water is adhered to the entire surface of the light-sensitive material 16.

In other words, even if the ejection tank 312 is not in contact with the light-sensitive material 16, uniform application of water onto the upper surface of the light-sensitive material 16 is possible. The bubbles F that have risen in the ejection tank 312 are discharged out of the ejection tank 312 from the exhaust pipe 330.

Further, the operation of the piezoelectric elements 326 causes the lever plates 320 to swing around the support portions 312B which extend along the direction along which the nozzle holes 324 are aligned linearly. Therefore, all of the portions of the nozzle plate 322 at which the plurality of the nozzle holes 324 are provided are uniformly displaced.

As a result, the nozzle holes 324 can be displaced stably by the same amount of displacement and collectively along the longitudinal direction of the nozzle hole row formed by the plurality of nozzle holes 324 disposed linearly. The water filled in the ejection tank 312 is thus uniformly ejected from the nozzle holes 324. Further, because the nozzle plate 322 forms the bottom wall of the ejection tank 312, it becomes even more difficult for water to fail to adhere to any portion of the surface of the light-sensitive material 16.

The nozzle plate 322 is composed of a thin plate material, the groove 322A is formed curvingly in the nozzle plate 322 so as to extend along the direction in which the plurality of nozzle holes 324 are aligned linearly.

Because the nozzle plate 322 is composed of a thin plate material having the groove 322A, the rigidity of the nozzle plate 322, due to the groove 322A, is maintained along the direction of linear alignment of the nozzle holes 324, and the amplitude required of the nozzle holes 324 is ensured due to the inherent low rigidity of the nozzle plate 322. Consequently, the atomization operation of the solvent application device 310 is stabilized so that the water filled in the ejection tank 312 can be reliably ejected from the nozzle holes 324.

Further, since the nozzle plate 322 is formed by a thin plate material, the small nozzle holes 324 can easily be formed to the same size in the nozzle plate 322 in the manufacturing process of the solvent application device 310.

Further, since the ejection tank 312 has the nozzle holes 324 from which water is ejected, a smaller amount of water is required for application than an application device which applies water to the light-sensitive material by the light-sensitive material being immersed in a tank filled with water. The light-sensitive material 16 can also be dried in a shorter time.

Furthermore, the ejection tank 312 has the plurality of the nozzle holes 324 disposed over the entire width of the light-sensitive material 16, and water is ejected simultaneously from these nozzle holes 324 by a single displacement of the piezoelectric elements 326. Therefore, water can be applied over a wide area along the entire width of the light-sensitive material 16 by a single ejection. Consequently, the nozzle plate 322 need not be scanned on a two-dimensional plane, and water application to a larger area in a shorter time is made possible, thereby reducing the time required for water application.

All that is required to manufacture the solvent application device 310 is to form a plurality of the nozzle holes 324 in the nozzle plate 322. Therefore, there is no need for an integration technique, and the solvent application device 310 can be manufactured at a lower cost.

Further, water can be applied to the entire surface of the light-sensitive material 16 by ejecting the water from the nozzle holes 324 plural times at an arbitrary timing conforming with the conveying rate of the light-sensitive material 16. When water is ejected from the nozzle holes 324 of the nozzle plate 322, the amount of water in the ejection tank 312 is progressively reduced. Although the amount of water in the ejection tank 312 is successively reduced, the subtank 338 has the function of keeping the water level in the ejection tank 312 constant by refilling water thereto. Therefore, the water pressure in the ejection tank 312 during atomization operation is kept constant by the water supplied from the subtank 338. Continuous water ejection is thus ensured.

Thereafter, the light-sensitive material 16, to which water serving as an image-forming solvent has been applied by the water application section 50, is fed between the endless belts 122, 124 of the thermal development-transfer section 120 by means of the conveying rollers 34.

As the light-sensitive material 16 is scan-exposed, on the other hand, the image-receiving material 108 is withdrawn and conveyed by the nip rollers 110 from the image-receiving material magazine 108. When the image-receiving material 108 is withdrawn by a predetermined length, the cutter 112 is activated to cut the image-receiving material 108 to a predetermined length.

After the cutting operation of the cutter 112, the image-receiving material 108 thus cut is guided by the guide plate and conveyed by the conveying rollers 132, 134, 136, 138. When the leading and portion of the image-receiving material 108 comes to be held by the conveying rollers 138, the image-receiving material 108 is set in a standby state directly before the thermal development-transfer section 120.

As the light-sensitive material 16 is fed between the endless belts 122, 124 by the conveying rollers 34 as described above, the image-receiving material 108 begins to be conveyed again. The image-receiving material 108 thus is fed integrally with the light-sensitive material 16 between the endless belts 122, 124.

As a result, the light-sensitive material 16 and the image-receiving material 108 are superposed on each other, and while being heated by the heating plate 126, are held and conveyed so that an image is formed on the image-receiving material 108 by thermal development and transfer.

Further, after the light-sensitive material 16 and the image-receiving material 108 are delivered from the endless belts 122, 124, the leading end portion of the light-sensitive material 16, which precedes the image-receiving material 108 by a predetermined length, engages with the separation pawl 128 so as to be separated from the image-receiving material 108. The light-sensitive material 16 is further conveyed by the light-sensitive material delivery rollers 148 so as to be fed into and accumulated in the waste light-sensitive material accommodation section 150. At this time, the light-sensitive material 16 is dried very quickly, and therefore no heater or the like is required to dry the light-sensitive material 16.

On the other hand, the image-receiving material 108 that has been separated from the light-sensitive material 16 is conveyed by the image-receiving material delivery rollers 162, 164, 166, 168, 170 and delivered into the tray 172.

In the case of recording a plurality of image frames, the above-mentioned processes are repeated successively.

The image-receiving material 108 on which a predetermined image has been formed (recorded) by thermal development and transfer between the endless belts 122, 124 is delivered out from the endless belts 122, 124. The image-receiving material 108 thus delivered is discharged to the exterior of the apparatus by being held and conveyed by the plurality of image-receiving material delivery rollers 162, 164, 166, 168, 170.

Explanation will now be given of the nozzle plate 322 of the ejection tank 312 according to a second embodiment of the invention, with reference to the enlarged view thereof in FIG. 10. The same component parts as those described in the first embodiment are designated by the same reference numerals respectively, and will not be described again.

Figure 10:
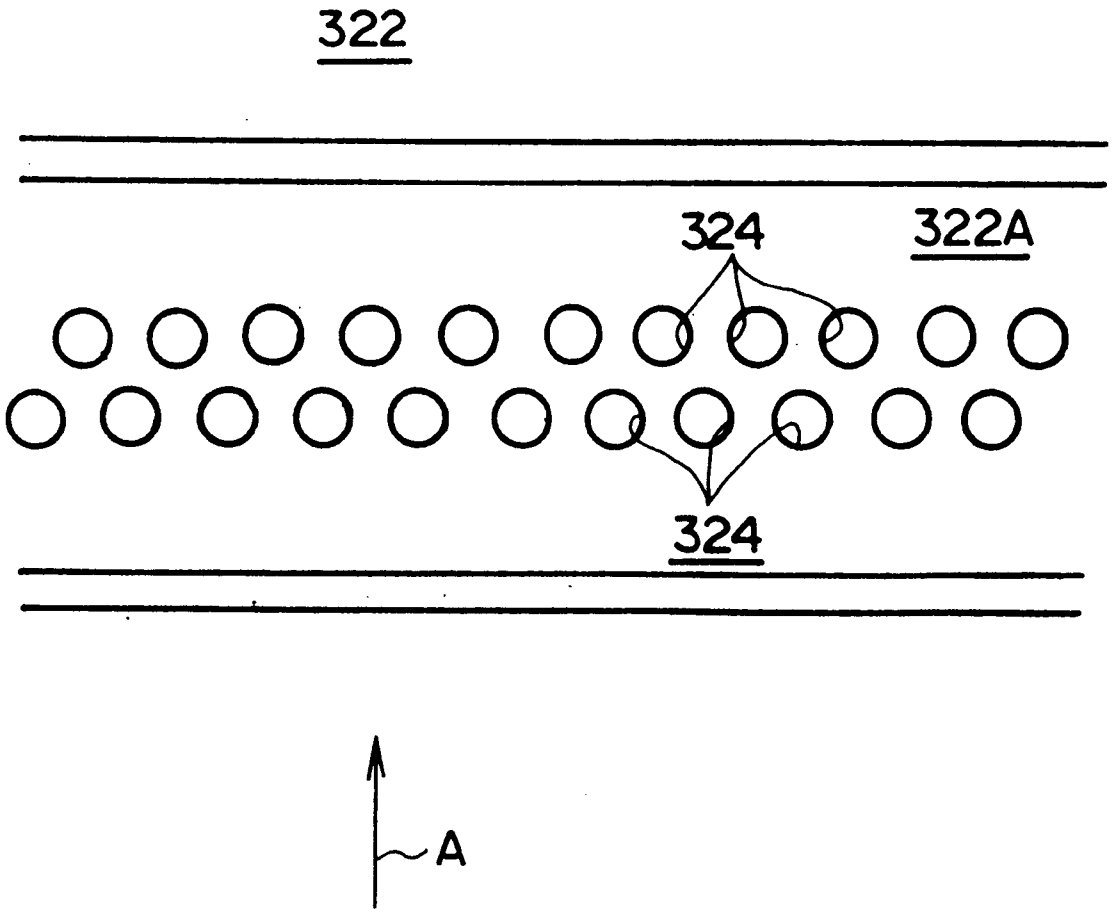
FIG. 10 is an enlarged view of main portions, showing an arrangement of nozzle holes in an ejection tank according to a second embodiment of the invention.

As shown in FIG. 10, the nozzle plate 322 of the ejection tank 312 according to the second embodiment is formed with the plurality of the linearly-aligned water-ejecting nozzle holes 324 being arranged in a staggered fashion at regular spatial intervals in two rows at an angle to the direction A in which the light-sensitive material 16 is conveyed.

This arrangement of the nozzle holes 324 has the same function and effects as the corresponding arrangement in the first embodiment. In addition, an area covered by two rows can be coated by a single ejection, and therefore, efficient application is made possible with a fewer number of operations of extending and contracting the piezoelectric elements 326.

The nozzle holes, which are arranged in one or two rows according to the first and second embodiments described above, may alternatively be arranged in three or more rows to further reduce the number of times the actuator must be driven.

Furthermore, the nozzle hole row is not necessarily perpendicular to the direction in which the light-sensitive material is conveyed as in the first and second embodiments described above. Instead, the nozzle holes may be arranged diagonally with respect to the conveying direction.

In the above-described embodiments, the light-sensitive material 16 and the image-receiving material 108 are used as image-recording materials, water is applied from the ejection tank 312 of the solvent application device 310 to the light-sensitive material 16 after exposure thereof, the light-sensitive material 16 and the image-receiving material 108 are overlaid one on the other, and thermal development and transfer are carried out. However, the present invention is not limited to the same, and water may be ejected toward and applied to the image-receiving material 108.

Furthermore, in addition to the materials described above, the present invention is equally applicable to other image-recording materials in sheet form or roll form. Moreover, an image-forming solvent other than water can be used. In addition, the method according to the present invention is applicable also to the application of a developer to a photographic printing paper in a developing device, the application of water in a printing press, a coating machine, and the like.

It can thus be understood from the foregoing description that the liquid ejection apparatus according to the present invention has the great advantage that an image-forming solvent can be applied uniformly onto an image-recording material.

What is claimed is:

1. A liquid ejection apparatus comprising:

an ejection tank disposed above a conveying path of an image-recording material so as to oppose the conveying path, and having an interior for storing an image-forming solvent;

a linear nozzle plate provided at said ejection tank as a bottom wall of said ejection tank so as to oppose the conveying path of the image-recording material, and having a plurality of nozzle holes aligned linearly so as to form a row of said nozzle holes, for ejecting the image-forming solvent; and actuator means disposed at side walls of said ejection tank and which are coupled to said nozzle plate by displacement transmission means, for moving the plurality of nozzle holes in said nozzle plates reciprocally toward and away from the image-recording material on the conveying path to eject a plurality of drops collectively in a linear direction from said row of nozzle holes;

wherein the image-forming solvent is water, and a bottom surface of said nozzle plate is subjected to water repellent processing; and wherein corner portions of said nozzle plate at peripheries of the nozzle holes at said interior of said ejection tank have curved cross-sectional structures.

2. A liquid ejection apparatus comprising:

an ejection tank disposed so as to oppose a conveying path of an image-recording material, and storing an image-forming solvent;

a linear nozzle plate provided at said ejection tank as a portion of a wall surface of said ejection tank so as to oppose the conveying path of the image-recording material, and having a plurality of nozzle holes aligned in a linear direction in a row, for ejecting the image-forming solvent on said image-recording material; and a curved groove portion extending along said nozzle plate in said direction in which the plurality of nozzle holes are disposed and aligned, said curved groove portion being formed in said nozzle plate in said linear direction; and actuator means disposed at side walls of said ejection tank and which are coupled to said nozzle plate by displacement transmission means, for moving said nozzle plate reciprocally toward and away from the image-recording material on the conveying path to eject a plurality of drops collectively in a linear direction from said row of nozzle holes;

wherein the image-forming solvent is water, and a bottom surface of said nozzle plate is subjected to water repellent processing; and wherein corner portions of said nozzle plate at peripheries of the nozzle holes at said interior of said ejection tank have curved cross-sectional structures.

3. A liquid ejection apparatus comprising:

an ejection tank disposed above a conveying path of an image-recording material so as to oppose the conveying path, and having an interior for storing an image-forming solvent;

a linear nozzle plate provided at said ejection tank as a bottom wall of said ejection tank so as to oppose the conveying path of the image-recording material, and having a plurality of nozzle holes aligned linearly so as to form a row of said nozzle holes, for ejecting the image-forming solvent; and actuator means disposed at side walls of said ejection tank and which are coupled to said nozzle plate by displacement transmission means, for moving the plurality of nozzle holes in said nozzle plates reciprocally toward and away from the image-recording material on the conveying path to eject a plurality of drops collectively in a linear direction from said row of nozzle holes;

wherein the image-forming solvent is water, and a bottom surface of said nozzle plate is subjected to water repellent processing; and wherein corner portions of said nozzle plate at peripheries of the nozzle holes at said interior of said ejection tank are subjected to hydrophilic processing.

4. A liquid ejection apparatus comprising:

an ejection tank disposed so as to oppose a conveying path of an image-recording material, and storing an image-forming solvent;

a linear nozzle plate provided at said ejection tank as a portion of a wall surface of said ejection tank so as to oppose the conveying path of the image-recording material, and having a plurality of nozzle holes aligned in a linear direction in a row, for ejecting the image-forming solvent on said image-recording material; and a curved groove portion extending along said nozzle plate in said direction in which the plurality of nozzle holes are disposed and aligned, said curved groove portion being formed in said nozzle plate in said linear direction; and actuator means disposed at side walls of said ejection tank and which are coupled to said nozzle plate by displacement transmission means, for moving said nozzle plate reciprocally toward and away from the image-recording material on the conveying path to eject a plurality of drops collectively in a linear direction from said row of nozzle holes;

wherein the image-forming solvent is water, and a bottom surface of said nozzle plate is subjected to water repellent processing; and wherein corner portions of said nozzle plate at peripheries of the nozzle holes at said interior of said ejection tank are subjected to hydrophilic processing.

* * * * *